US008414342B2

(12) United States Patent
Wille et al.

(10) Patent No.: US 8,414,342 B2
(45) Date of Patent: Apr. 9, 2013

(54) STEEL PIPELINE FLUID TRANSFER SYSTEM

(75) Inventors: Hein Wille, Eze (FR); Jack Pollack, Monaco Cedex (MC)

(73) Assignee: Single Buoy Moorings, Inc., Marly (CH)

( * ) Notice: Subject to any disclaimer, the term of this patent is extended or adjusted under 35 U.S.C. 154(b) by 1049 days.

(21) Appl. No.: 12/016,929

(22) Filed: Jan. 18, 2008

(65) Prior Publication Data

US 2009/0186538 A1 Jul. 23, 2009

(51) Int. Cl.
*B63B 22/02* (2006.01)

(52) U.S. Cl.
USPC ..... 441/4; 405/195.1

(58) Field of Classification Search ..... 114/230.1; 405/158, 165, 166, 195.1; 441/3, 4, 5
See application file for complete search history.

(56) References Cited

U.S. PATENT DOCUMENTS

| | | | | |
|---|---|---|---|---|
| 3,581,506 | A * | 6/1971 | Howard | 405/166 |
| 3,677,302 | A * | 7/1972 | Morgan | 441/4 |
| 3,811,142 | A | 5/1974 | Westra | |
| 5,639,187 | A | 6/1997 | Mungall et al. | |
| 5,947,642 | A * | 9/1999 | Teixeira et al. | 405/195.1 |
| 6,109,989 | A | 8/2000 | Kelm et al. | |
| 6,659,690 | B1 | 12/2003 | Abadi | |
| 6,688,814 | B2 | 2/2004 | Wetch et al. | |
| 6,739,804 | B1 | 5/2004 | Haun | |
| 6,763,862 | B2 | 7/2004 | Fontenot et al. | |
| 6,769,376 | B2 | 8/2004 | Perera et al. | |
| 6,779,949 | B2 | 8/2004 | Barras et al. | |
| 6,824,330 | B2 | 11/2004 | Grobe | |
| 6,835,025 | B1 | 12/2004 | Beard et al. | |
| 6,983,712 | B2 | 1/2006 | Cottrell et al. | |
| 7,029,348 | B2 | 4/2006 | Bauduin et al. | |
| 7,179,144 | B2 * | 2/2007 | De Baan | 441/5 |

FOREIGN PATENT DOCUMENTS

| | | | |
|---|---|---|---|
| GB | 2335723 | A | 9/1999 |
| GB | 2336382 | A | 10/1999 |
| GB | 2351724 | A | 1/2001 |
| WO | WO99/54197 | | 10/1999 |
| WO | WO03/062043 | A1 | 7/2003 |
| WO | WO03/064809 | A1 | 8/2003 |
| WO | WO03/087527 | A1 | 10/2003 |
| WO | WO2007/082905 | A1 | 7/2007 |

* cited by examiner

*Primary Examiner* — Lars A Olson
(74) *Attorney, Agent, or Firm* — Leon D. Rosen

(57) ABSTRACT

A steel pipeline (22) extends in a shallow catenary curve between two floating structures (12, 14). The pipeline is connected to each floating structure in a joint (60, 60B) that has a center lying on or very close to the pitch and roll axes (54, 56, 54B, 56B) of the corresponding structure hull. A first structure has a recess (52) extending upward from the bottom of the first structure hull to at least the pitch and roll axes of the hull. The shallow catenary curve pipeline extends at an incline (C) of many degrees to the vertical into the recess, and the pipeline end (30) connects to a pipe connector (70) lying on the pitch and roll axes. The pipe connector preferably allows free relative pivoting of a plurality of degrees about horizontal axes between itself and the first pipe end.

12 Claims, 5 Drawing Sheets

FIG. 4
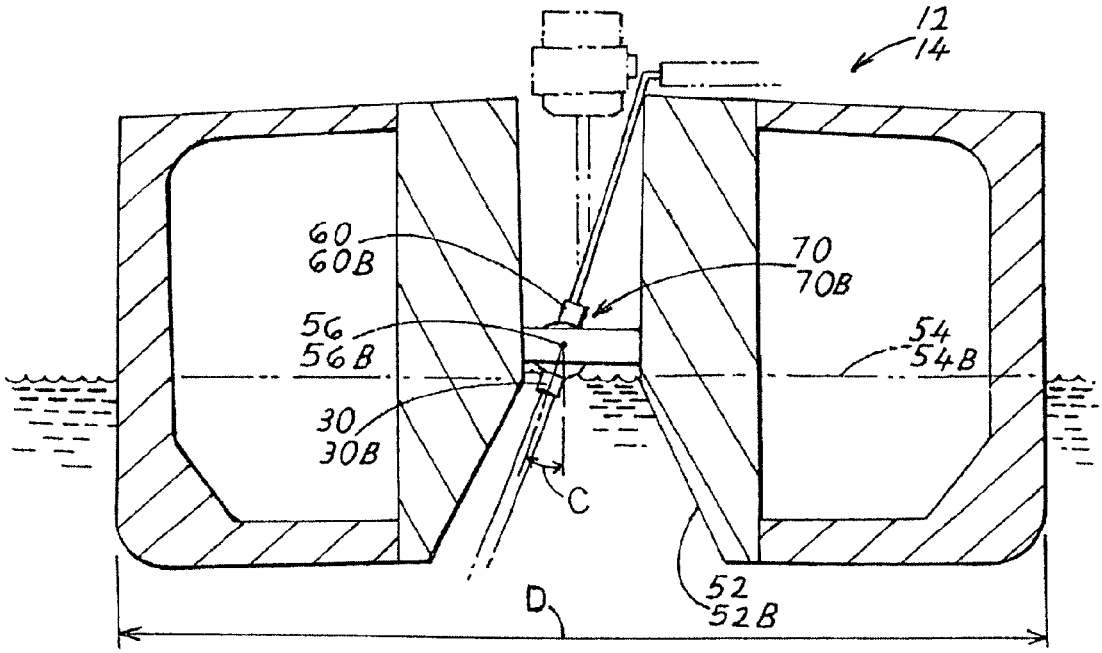
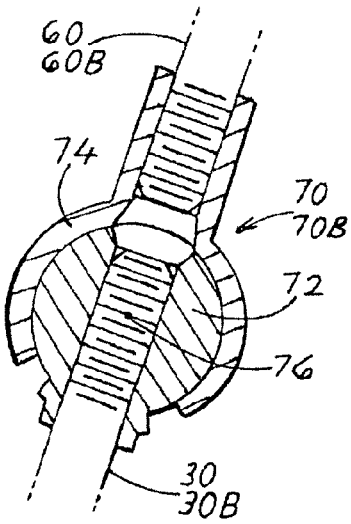
FIG. 5
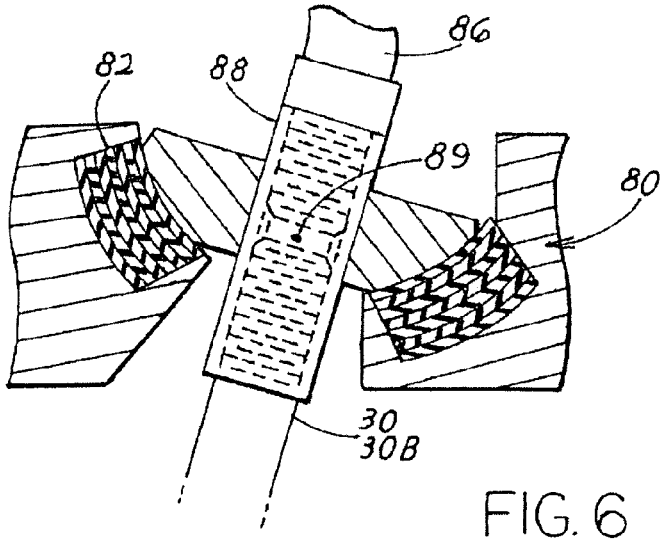
FIG. 6

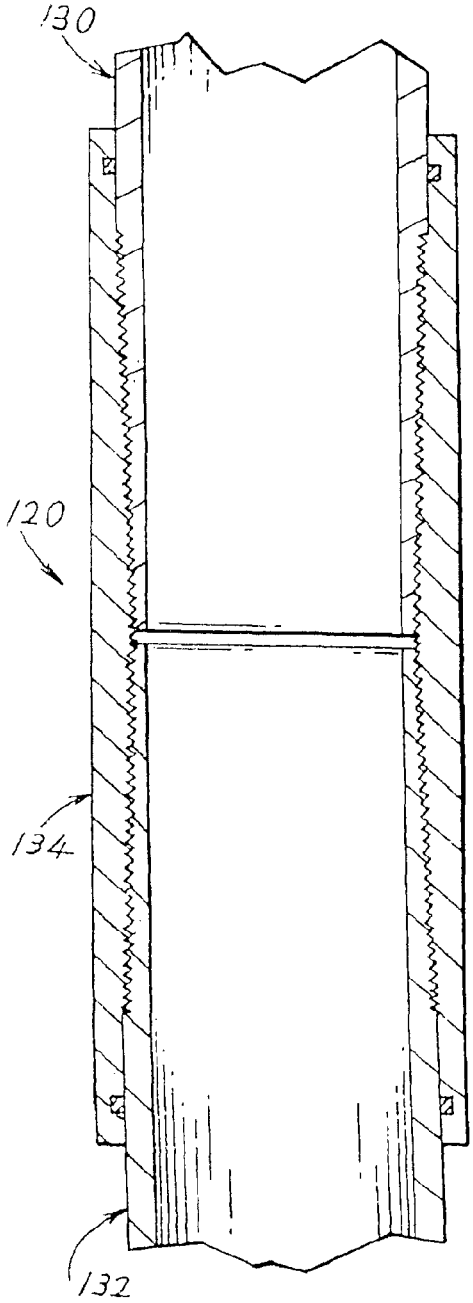
FIG. 7
FIG. 8
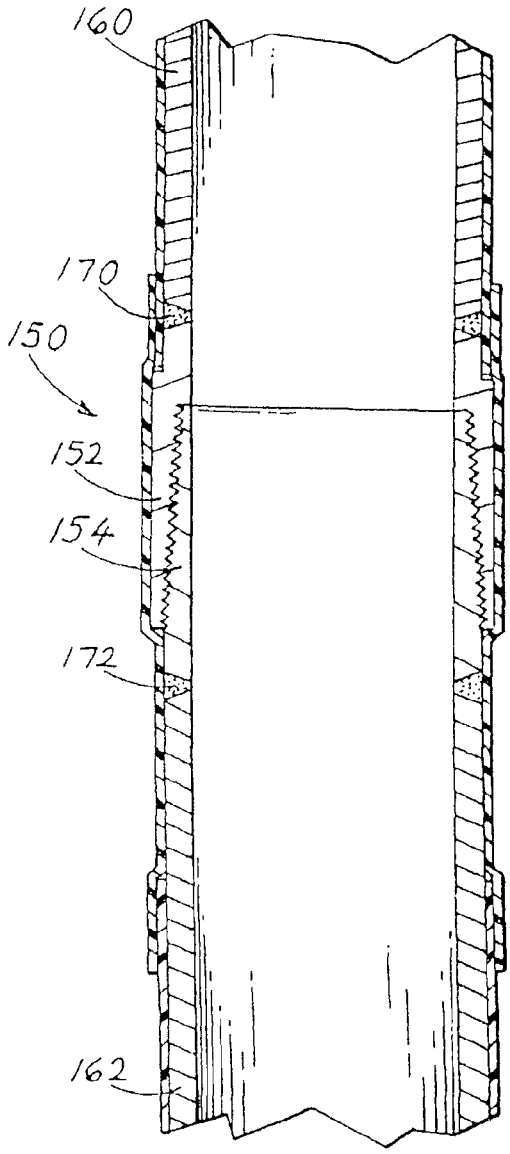

STEEL PIPELINE FLUID TRANSFER SYSTEM

BACKGROUND OF THE INVENTION

There are applications where hydrocarbons are to be transferred between floating structures, such as between a production vessel that produces and stores hydrocarbons from an undersea reservoir and a buoy for offloading the stored hydrocarbons at regular intervals to a tanker that is moored to the buoy. The hydrocarbons can be transferred through a pipeline that extends in the sea between the structures and that is connected in a pipe joint at each structure. One problem encountered with such a system is that there is repeated stressing of each pipe end due to pitch, roll and heave of the corresponding floating structure. Such repeated stressing, especially in the wave action zone, can result in fatigue failure of the pipe end and of a corresponding pipe connector on the floating structure. Ways to construct a fatigue resistant midwater pipe and ways to minimize such stressing at minimum costs would be of value.

U.S. Pat. No. 6,779,949 shows a catenary or U-shaped steel midwater pipe where the pipeline ends are placed entirely below the wave turbulent zone. The pipe ends are connected to the floating structure, or floater with flexible hoses in the wave active zone. U.S. Pat. No. 6,769,376 shows a midwater system which includes multiple steel pipe sections with clamped fixed spacers at the pipe section ends and flexible spacers in between, which allows for a relative movement of the pipes to each other. These patents include either a upper flexible part or a spacer means.

Patent application GB2335723 shows a riser decoupling system with a weight-carrying chain or cable part between the floater and the end of the steel midwater pipe. In this way relative movement between the buoy and the end of a subsea pipeline is accommodated by a suspended member in the form of a chain, rope or cable. In that patent the fluid path between the end of the pipeline and the buoy includes a flex hose. Other systems for decoupling the motion of the surface floater from a steel midwater pipes by creating a distance between the steel midwater pipe end and the floater, are shown in patent publications U.S. Pat. No. 6,109,989 and US20030084961.

Patent application WO03062043 shows a special design for a deepwater buoy which at its lower part is connected to a steel horizontal transfer duct via a flex joint. The sections of the steel transfer pipe are welded together and are subject to large fatigue loads as it is placed in the wave active zone. The design of the buoy is such that it reduces fatigue loads of the mooring lines and the horizontal transfer duct; the buoy is therefore made slender and relatively long such that the horizontal fluid transfer duct extends below the wave active zone. The fluid duct is therefore less subject to fatigue loads due to the shape of the buoy and the fact that it is placed under the wave active zone, so that a welded midwater pipe arrangement can be used without the danger of (fatigue) cracks being introduced to the welded area of the midwater pipe.

SUMMARY OF THE INVENTION

In accordance with one embodiment of the invention, a fluid transfer system is provided for transferring fluid between structures in the sea, especially where each structure floats, that is of moderate cost, that is provided with fatigue resistant pipe section connections and that minimizes changes of stresses on the ends of a pipeline that carries fluid between the structures. The system includes a steel pipeline for deep waters that extends above the sea floor, with the pipeline extending partly in the wave active zone of the sea, in a shallow catenary curve between the floating structures. The steel pipeline consists of multiple steel pipe sections connected in series in mechanical pipe joints. This avoids welded pipe joints which cannot withstand fatigue stresses present in the wave zone. A first floating structure has a first hull with pitch and roll axes about which the hull pivots in the presence of waves. It is preferred that the connection be as close as practical to the Center of Gravity (CG) of the floater (CALM buoy, FPSO, etc), or on the outside of the floater hull near mid-ship either above or below water. The upper ends of the midwater pipe are placed in an open area adjacent to the roll and pitch axes of the floating structure, or can be placed in an area within turret walls of a weathervaning structure, where that area contains the roll and/or pitch axes.

In a preferred embodiment, applicant provides a recess in the bottom of the first hull, and places a pipe connector within the recess near the pitch and roll axes. A first end of the steel pipeline extends at an incline of many degrees from the vertical up into the recess, where the first end of the pipeline connects to the pipe connector to form a first joint. The incline is the beginning of the catenary curve along which the steel pipeline extends. As the first hull pivots about its pitch and roll axes in the presence of waves, the first end of the pipeline undergoes repeated up and down movement. However, movements of the first pipe end are minimized because the pipeline first end lies near the axes of pivoting. As a result, repeated bending of the pipeline over its length and especially near its first end, and changes in stresses on the overall pipeline and especially near its first end, are minimized to avoid early fatigue failure caused by repeated bending stresses.

The pipe connector is preferably part of or mounted on, a pivot joint that allows the pipe connector on the floating structure to pivot relative to the first pipe end about the pitch and roll axes, by a plurality of degrees with minimum torque. Such pivoting in opposite directions from a quiescent orientation of the system, results in the pipeline first end moving up and down less, and in avoiding changes in torque stresses on the first joint.

The steel midwater pipe with quick mechanical couplings or connections could be of a variety of shapes but preferably is a U-shape as in FIG. 1, or lazy-wave configuration that includes a buoy that raises the middle of the pipeline.

The steel midwater pipe arrangement of the invention can be a single offloading pipeline but can also consist of multiple pipelines of different diameters for the transfer of different fluids (crude pipeline, gas pipeline, water injection pipe) and be combined with a power cable and/or umbilical lines. In case of a midwater pipe arrangement consisting of multiple steel pipes, each steel pipe is assembled of pipe sections that are coupled together via a mechanical coupling that can handle the large stresses and fatigue forces acting on the ends of the interconnected pipe sections. In addition, several clamps are placed at regular intervals along the multi-pipe midwater pipe arrangement to keep the pipes at a distance from each other. Each clamp allows for a relative displacement of each pipe in axial directions so as to be able to deal with the differences in temperature of the fluid transferred in each pipe and the resulting differences in contraction and expansion in length of each pipe in the bundle. This can for example, be achieved by a sliding support member (i.e. Teflon) for each pipe in the clamp. The clamp can be combined with buoyancy cans or separate buoyancy modules can be distributed along the pipe or pipeline bundle.

The ends of the pipeline are connected to the floating vessels, preferable in the neutral zone (near the pitch and roll axes) to avoid large stresses on the end connections. It is also possible to connect the steel midwater pipe directly into the internal or external turret of a weathervaning FPSO (floating production storage and offloading). The end connections are preferably flexible, so they can stand torque, stress and pull forces and can be in the form of a stress-joint (see U.S. Pat. No. 6,659,690), a flex-joint, a gimbal table (see WO 2007/082905), a latch connector, a ball-joint, etc, which are all well known solutions in the offshore industry. A gimbal table connection for example allows for full free rotation in any direction like a cardan joint.

The steel midwater pipe or even a midwater pipe bundle can be assembled and installed by pulling it out from one of the floaters or from a floater having a tower for making up pipes with mechanical (not welded) connections such as threaded or clamped connections. The pipe will not touch the seabed when being pulled out from the floater where it is assembled, which can be a FPSO, a drilling rig, a lay vessel, etc. At the floater where the steel midwater pipe is assembled an extra insulation or protective layer can be added over the coupling to protect the coupling and avoid the ingress of seawater in the coupling or in scratches in the coupling made during the assembling process.

The novel features of the invention are set forth with particularity in the appended claims. The invention will be best understood from the following description when read in conjunction with the accompanying drawings.

BRIEF DESCRIPTION OF THE DRAWINGS

FIG. 4 is a sectional view of the hull of the floating structures of both FIG. 2 and FIG. 3.

FIG. 5 is a sectional side view of the joint of FIG. 4 where the pipeline first end connects to the floating structure pipe connector.

FIG. 6 is a sectional view of a joint of another embodiment of the invention which uses elastomeric material in a pivot joint.

FIG. 7 is a sectional view of one type of mechanical pipe connection joint for the steel pipeline of FIG. 1.

FIG. 8 is a sectional view of another type of mechanical pipe connection for the pipeline of FIG. 1.

DESCRIPTION OF THE PREFERRED EMBODIMENTS

Figure 1:
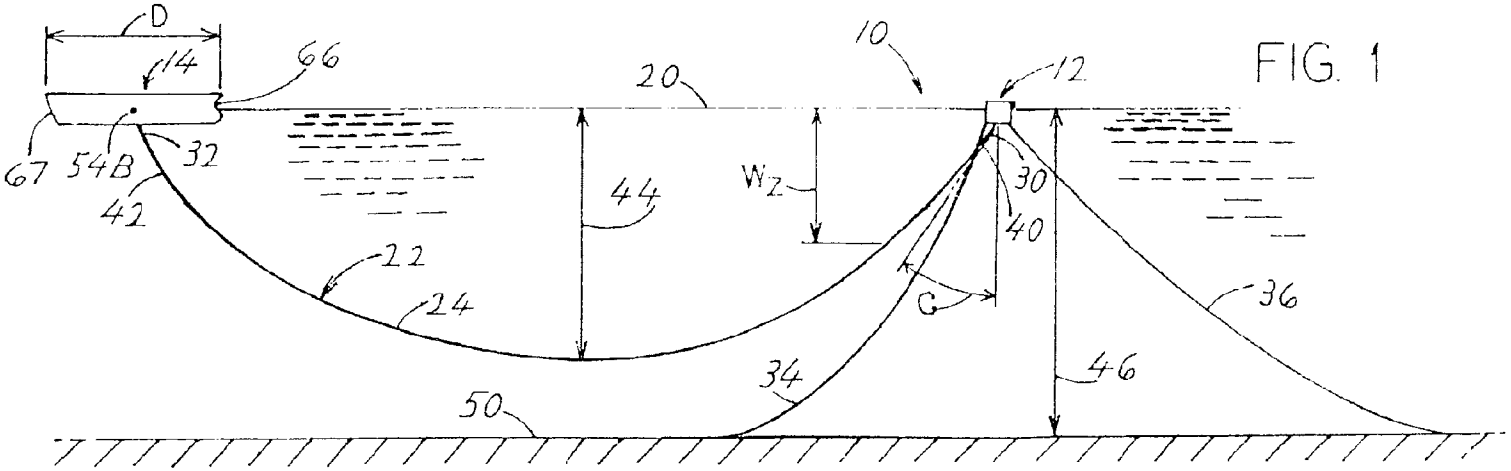
FIG. 1 is a side elevation view of a fluid transfer system of the invention, shown in a quiescent condition of the system.

FIG. 1 shows a fluid transfer system 10 of the invention that includes two floating bodies or structures 12, 14 that float at the sea surface 20. The floaters, or floating structures, are connected by a pipeline 22 that has opposite ends 30, 32 connected to the two structures. The first floating structure 12 is shown as a buoy while the second one 14 is shown as a vessel with an elongated hull. The pipeline 22 is a steel pipeline formed by multiple steel pipe sections connected in series. The steel pipeline does not extend with low tension at close to the vertical from each floating structure down to the sea floor. Instead, the steel pipeline extends at high tension in a shallow catenary curve 24 that usually lies completely above the sea floor 50. The use of a steel pipeline enables rapid deployment of the pipeline by a method that includes lowering steel pipe sections each of a length such as 24 meters from a vessel, and connecting a next pipe section to the last pipe section when it has been lowered, with the string of pipe sections slowly pulled from away from the lowering vessel to the other one. Such installation of a steel pipeline is shown in US Publication no 2006-0201564, although applicant prefers to not have the steel pipeline settle on the sea floor if the sea is deep enough to avoid this.

The first floating structure 12 is shown moored by a plurality of mooring chains 34, 36. The second structure 14 usually will be moored, by one of several types of mooring system (not shown). The opposite end portions 40, 42 of the steel pipeline extend at large angles C to the vertical, as parts of a catenary curve 24 of limited depth 44 which is less than the depth 46 of the sea in the vicinity of the system. As a result the pipeline does not lay on the sea floor 50. The shallow catenary curve, with opposite ends extending at least 20° to the vertical, avoids damage to the pipeline from any potentially harmful objects on the sea floor. It also provides high tension in the pipeline, which avoids damage even when one of the vessels moves downward in a large wave. However, the large tension could lead to fatigue failure if there are repeated large bending stresses.

Much of the pipeline (e.g. 40%) lies in the "wave zone" Wz which commonly extends to 400 meters below the sea surface 20. As a result, the pipeline is subjected to repeated changes in tension. The fact that the pipeline extends in a shallow catenary curve and is formed of steel pipe sections connected in series, results in high pipeline tension that has the advantage that the tension does not fall to zero. To avoid fatigue failure and minimize cost, applicant connects pipeline sections by mechanical joints rather than welded joints. The steel midwater pipe parts are interconnected with a quick connection coupling mechanism such as a threaded (helical or parallel threads), a clamped, a click-on, a bolded, etc. connection. Any pipe section with e.g. threaded ends welded to the rest of the same pipe section has the weld performed on shore where the weld can be assumed to be of high quality. Only the connection together of e.g. 24 meter length pipe sections, is here considered a pipe connection.

Alternatively or in combination with the use of different pipe couplings, the steel midwater pipe 22 can be assembled from steel pipe sections of different weight. The pipe section that is in the wave active zone (Wz) has larger wall thickness than the pipe section which is placed in the quiescent zone (below Wz). The steel midwater pipe 22 could also be assembled of sections of pipe that have different material characteristics or even assembled of pipe sections made of different materials. It is an option to add flexible parts or pivoting points in the middle of the midwater pipe which could be needed in rough environmental conditions, so that the movements of one or both floaters (12, 14) are decoupled from the main part of the midwater pipe. This can be done by adding a flex joint or a gimbal table or uni-joint at a certain place or places within the steel midwater pipe at a location closer to the middle of the pipeline than to its ends. However, this generally is not used and is not preferred.

Figure 9:
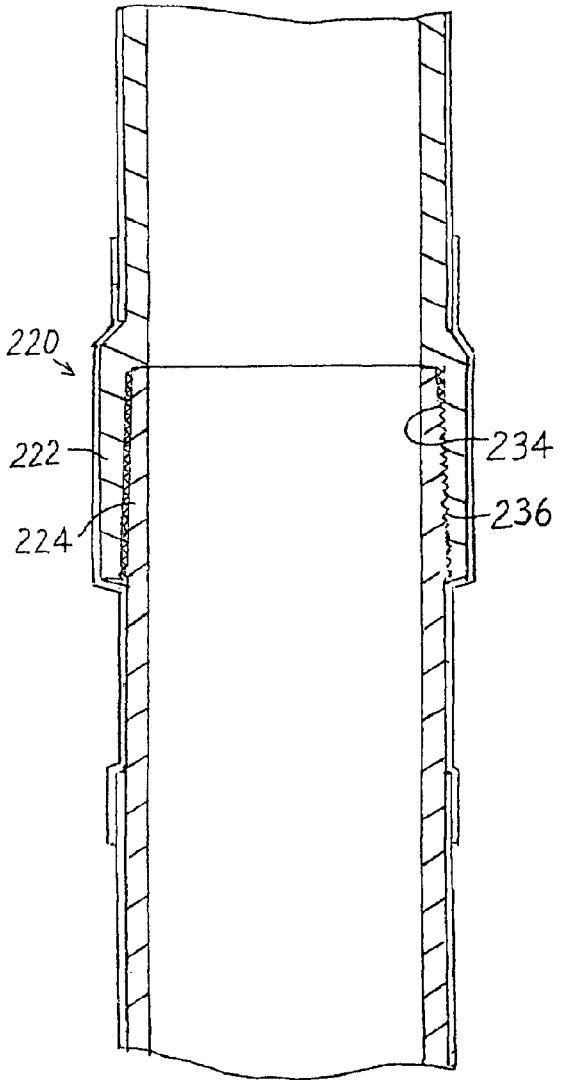
FIG. 9 is a sectional view of another type of mechanical pipe connection for the pipeline of FIG. 1.
Figure 10:
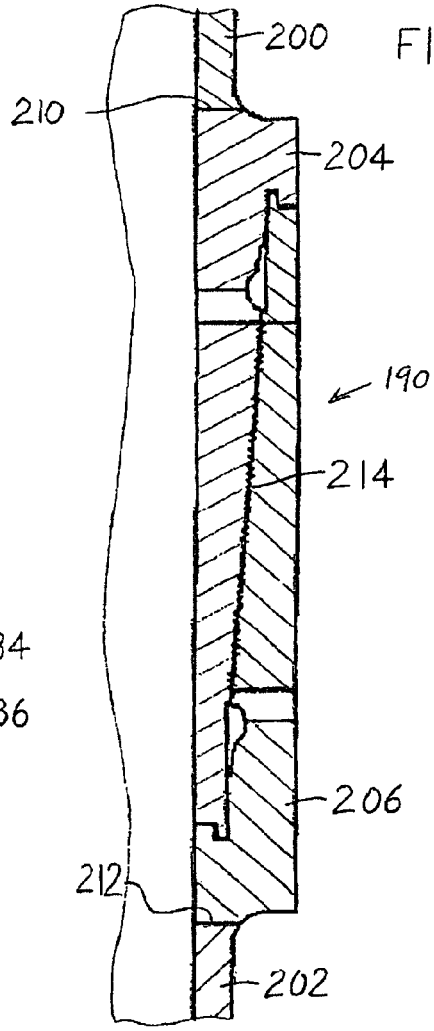
FIG. 10 is a sectional view of another type of pipe connection joint for the pipeline of FIG. 1.

FIG. 7 shows one type of fatigue-resistant pipe joint 120 which includes two pipe sections 130, 132 joined by a threaded sleeve 134. FIG. 8 shows another fatigue-resistant pipe joint 150 having two pipe sections 160, 162 with threaded ends 152, 154 connected by a thread connection. The pipe ends 152, 154 are joined by weld connections 170, 172 to main portions of the pipe sections. The weld connections are performed on shore before pipe sections are joined in tandem and lowered into the sea so they are not considered to be weld joints which joint two tandem pipe sections. Other mechanical connections besides simple threads are parallel threads (instead of helical threads) clamped, click-on and bolded couplings, which are characterized by no weld required to join pipe sections as they are placed in line for lowering into the sea. FIG. 9 shows a pipe connection 220 wherein one pipe end 222 has been expanded and internally threaded to the other one 224. FIG. 10 shows a pipe joint 190 wherein the pipe ends 204, 206 have been welded (while on shore) to the ends of pipe lengths 200, 202 at welds 210, 212, and threadably connected at 214.

Figure 2:
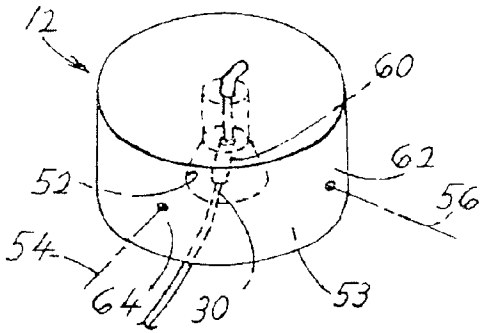
FIG. 2 is an isometric view with hidden lines, of a first of the floating structures of the system of FIG. 1.
Figure 3:
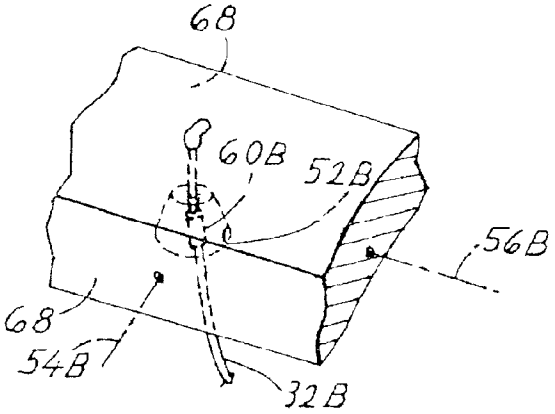
FIG. 3 is a partial isometric view with hidden lines, of a second of the floating structures of the system of FIG. 1.

FIG. 2 shows that the first floating structure 12 has a hull 51 with a top and with a recess 52 in its bottom 53, that extends upward and extends through a pitch axis 54 and a roll axis 56 of the first structure. These two axes 54, 56 are horizontal and perpendicular, and lie approximately at the height of the sea surface. The pivot axes 54, 56 lie at the height of the floating structure 12 rather than much below it. The pitch axis extends between opposite sides 64 of the hull and the roll axis extends between opposite ends 62 of the hull. The first end 30 of the pipeline extends at an incline of a plurality of degrees up into the recess by a vertical distance of more than a meter, and connects to conduit 60 that lies within the recess and connects to the hull. The second floating structure 14 is similar to the first one except that it has a length along its roll axis 56B (FIG. 3) between its bow and tern ends 66, 67 (FIG. 1) that is at least four times its width along its pitch axis 54B between its opposite sides 68. The second pipeline end 32B extends at an incline of a plurality of degrees from the vertical into a recess 52B and the pipeline second end 32B connects to a conduit 60B in the recess.

FIG. 4 shows the cross-sections of the two floating structures 12, 14, the cross-section along the pitch axes being identical. An end of the conduit 60, 60B of each floating structure and each pipe end 30, 30B lie close to both the pitch axis 54, 54B and the roll axis 56, 56B. The distance of the end of conduit 60, 60B from the pitch axis is less than 20% of the distance D between hull opposite sides or ends, preferably less than 10% of D, and more preferably less than 5% of distance D. The distance of the joint center (76, FIG. 5) from the pitch and roll axes is less than, preferably less than one-half, and more preferably less than one-quarter, of the distance of each axis from the opposite sides or ends or deck or bottom of the floating structure. The angle of the incline C (FIG. 4) of each pipe end to the vertical is a plurality of degrees and is usually at least 20°, in the quiescent condition of the system as a result of a catenary curve of shallow depth. Forces on the pipe ends 30, 30B continually vary as the floating structure moves up and down and pitches and rolls. However, movement of each pipe end 30, 30B due to pitch and roll is a minimum because the pipe end lies close to the pitch and roll axes 54, 54B and 56, 56B.

Applicant has designed a fluid transfer system of the type shown in FIGS. 1-4 for a sea location of a depth 46 of 745 meters. The floating structures 12, 14 lay 2000 meters apart, and the catenary had a bottom lying a distance 44 of 560 meters below the sea surface, or 155 meters above the sea floor. The incline from the vertical of each pipe end was more than 20°. Thus, the ratio of catenary length to catenary depth was more than three to one. This results in high tension in the pipeline and the desirability to minimize changes in such tension to avoid fatigue failure. The fluid transfer system can be used in the wave active zone in large water depths (up to 3000 m water depths) as well.

Another continually varying force that might be applied to the pipe end 30, 30B is torque as the connector 60, 60B pivots with pitch and roll. Applicant substantially avoids such varying torque by constructing the pipe joint 70, 70B where the pipe conduit 60, 60B connects to the pipe end 30, 30B as a flexible connection to enable relative pivoting about the horizontal pitch and roll axes. FIG. 5 shows on example of such a joint 70, 70B which includes a ball 72 connected to the pipe end and a socket 74 connected to the conduit 60, 60B that is mounted on the floating structure. The joint allows only limited "free pivoting" (pivoting without damage such as permanent deformation) about the pitch and roll axes, which is usually at least 15° but that usually is sufficient, about the joint center 76, relative to the floating structure (including relative to a turret on a floating structure). The joint 70, 70B does not allow the pipe 30 to slide through the joint.

FIG. 6 shows another joint 80 which enables limited free pivoting (pivoting without damage) about the pitch and roll axes, and which uses plates 82 of elastomeric material to absorb the pivoting. The plates 82 are under compressive forces due to the weight of the pipeline. When the pipe end 30, 30B pivots, the compressive load on one side of the plates is reduced and the compressive load on the other side of the plates is increased. A flexible hose 86 connects the connector 88 to a pipe on the floating structure. The joint center 89 lies close to the pitch and roll axes.

Figure 11:
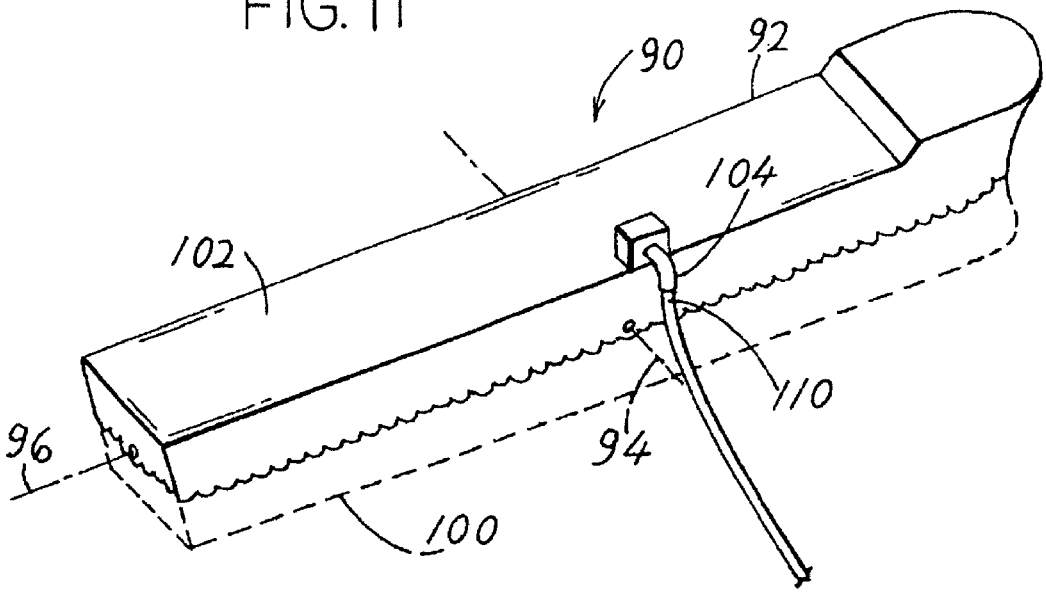
FIG. 11 is a partial isometric view of a fluid transfer system of another embodiment of the invention wherein a first pipe end is not located near the roll axis of the floating structure hull.

FIG. 11 illustrates a floating structure in the form of a vessel 90 with a hull 92 that has pitch and roll axes 94, 96. The hull also has a bottom 100 and a deck 102. In this situation, it is much more convenient to place the pipeline connector 104 at the deck 102, with the pipeline first end 110 extending downward at an incline to the vertical, from the connector 104 that lies at the height of the deck. To minimize movement of the pipeline end when the vessel pitches, applicant places the connector 104 close to the pitch axis 94, and preferably locates the connector 104 below the deck to further minimize connector movement. The connector lies considerably from the roll axis 96 but since the width of the vessel along the roll axis is small, pipeline end movement is limited.

Thus the invention provides a fluid transfer system that includes a steel pipeline that extends between bodies that both lie in the sea, and especially where both bodies float on the sea surface. The system is constructed to it can be installed at moderate cost and minimizes fatigue at the pipeline ends, which are the most vulnerable to fatigue failure. The pipeline lies in a shallow catenary curve, which raises the middle of the pipeline above the sea floor. This results in high pipeline tension and the possibility of high loads on a first pipe end when the first floating structure is tilted as it encounters waves. Applicant prefers to construct the first floating structure so it has a recess in the bottom of the hull, with the first recess extending though the pitch and roll axes. The pipeline connector that is mounted on the first hull, lies close to the pitch and roll axes, so the pipeline end experiences minimum movement when the hull pivots about one or both axes. The joint where the pipe end connects to the pipeline connector on the floating structure, is preferably a pivot joint that allows a plurality of degrees of pivoting about the pitch and roll axes to limit torque on the pipe end. The pipeline consists of steel pipe sections connected in series, in pipe joints where pipe ends are connected together mechanically rather than by welding, for high fatigue resistance under the high tension of a shallow catenary curve.

Although particular embodiments of the invention have been described and illustrated herein, it is recognized that modifications and variations may readily occur to those skilled in the art, the midwater pipe could be attached to a floating production unit like a FPSO, SPAR, TLP, at almost any location depending on analysis of fatigue, and consequently, it is intended that the claims be interpreted to cover such modifications and equivalents.

What is claimed is:

1. A fluid transfer system that lies in a sea that has a sea surface and a wave action zone, and that includes first and second floating structures that have respective first and second hulls that each floats at the sea surface, said system including a steel pipeline that extends in the sea in a catenary curve between said structures and that has first and second pipeline ends connected respectively to said first and second structures, wherein:

said steel pipeline has end portions (40, 42) that each extends through the wave action zone of the sea and said steel pipeline comprises multiple steel pipe sections that are directly connected together;

at least a first end of the steel pipeline is directly coupled to said first floating structure via a connection that includes a pipe joint (70, 70B) that has a joint center (76, 89), with said pipe joint constructed to allow said first end of said steel pipeline to freely pivot by a plurality of degrees about horizontal axes that pass through said joint center relative to said first floating structure while preventing said pipeline end from sliding through said joint.

2. A fluid transfer system according to claim 1, wherein:

said first structure includes a hull that floats at the sea surface and that has opposite sides spaced by a first distance and opposite ends spaced by a second distance and a hull top and bottom;

said first structure having a roll axis that extends between said opposite ends and a pitch axis that extends between said opposite sides;

said pipe joint has a joint center located closer to said pitch axis than to either of said first structure ends.

3. The system described in claim 1 wherein:

said first and second hulls have respective first and second pitch axes and first and second roll axes;

said first hull has a recess in its bottom with a recess lower end that lies under said pitch axis and under said roll axis and with said first joint lying in said recess at least one meter above said recess lower end, and said pipeline first end extends at an upward angle of a plurality of degrees from the vertical into said recess and is attached to said first joint to prevent the pipeline end from sliding through said first joint.

4. The system described in claim 3 wherein:

said first structure has opposite ends (62, 66, 67);

said first joint has a center that is closer to said pitch axis than 10% of a distance D between said first structure opposite ends.

5. The system described in claim 3 wherein:

said first hull has a top (55, 102) and a bottom (53, 100) spaced by a third distance and said first hull has opposite sides (64, 68, 98):

said first joint has a center that is closer to said roll axis than to either of said sides of said first hull or to either said top or bottom.

6. The system described in claim 1 wherein:

said first structure has roll and pitch axes (94, 96), and said first hull has bow and stern ends and is elongated with a length between said ends being more than four times its width between said sides, and said first structure has a deck that lies above the sea surface, wherein:

said first joint is mounted to said deck, and said first joint lies directly above said pitch axis (94) and lies to one side of said roll axis (96).

7. The system described in claim 1 wherein:

said catenary curve is a shallow curve, with the length of said catenary curve being at least three times the height of said curve, and said pipe ends lie in said floating structures and each extends at an incline of more than 20° to the vertical in a quiescent condition of said system.

8. A fluid transfer system that includes a steel pipeline with opposite pipeline ends, said pipeline extends in a catenary curve in a sea between first and second floating structures, wherein each structure has a hull with perpendicular horizontal pitch and roll axes and with a length and width respectively along said roll and pitch axes, wherein:

said first floating structure has a bottom and has a recess in its bottom that extends upward into the hull said recess being positioned so said pitch and roll axes extend through the recess said first structure has a first connector that connects to said first end of said pipeline while preventing the pipeline end from sliding through the first connector, to form a joint that lies in said recess and that has a joint center close to said pitch axis so the distance between the joint center and said pitch axis is less than 10% of the structure length along said roll axis, said joint constructed to allow said pipeline first end to pivot about axes that are parallel to said pitch and roll axes.

9. The system described in claim 8, wherein:

said sea has a wave zone in a region lying between said floating structures;

said steel pipeline has a height no more than three times its length, and said pipeline first end extends at an incline of at least 20 degrees to the vertical where it enters said recess, said joint center lies more than a meter above a bottom of said vessel, and said first end of said pipeline extends through said wave zone to said joint.

10. The system described in claim 8, wherein:

said first pipe end has a part that connects to said joint and that is freely pivotable about said pitch and roll axes relative to said connector by a plurality of degrees.

11. A fluid transfer system that includes first and second structures that each floats at the sea surface of a sea region that has a sea floor and that has a wave zone, and a pipeline that extends in the sea between said structures and that has first and second pipeline ends connected respectively to said first and second structures, wherein:

said pipeline is formed of steel pipes connected in series, said pipeline extends in a shallow catenary curve that lies above the sea floor, with a catenary curve horizontal length at least three times its vertical height, and said pipeline ends each extends at an incline to the vertical of more than 20°;

a first of said structures has a pivot joint that permits pivoting about horizontal axes that lie at the height of said first structure;

said first pipeline end connects to said pivot joint in a connection that does not allow pipe sliding along said pivot joint, and said steel pipes of said pipeline extend through said wave zone.

12. The system described in claim 11 wherein said first structure has perpendicular horizontal pitch and roll axes and has opposite ends, and wherein:

said horizontal axes of said pivot joint include a horizontal axis that lies closer to said pitch axis (54, 54B, 94) than 10% of a distance D between opposite ends (62, 66, 67) of said first structure.

* * * * *